United States Patent [19]

Branaman

[11] Patent Number: 4,650,106

[45] Date of Patent: Mar. 17, 1987

[54] APPARATUS FOR ALIGNING AND CLAMPING A WORKPIECE

[76] Inventor: David H. Branaman, 1409 N. Independence, Harrisonville, Mo. 64701

[21] Appl. No.: 700,604

[22] Filed: Feb. 11, 1985

[51] Int. Cl.[4] ..... B27F 17/28

[52] U.S. Cl. ..... 227/152; 269/305; 269/900

[58] Field of Search ..... 227/152; 269/41, 45, 269/298, 299, 900, 902, 910, 303, 305

[56] References Cited

U.S. PATENT DOCUMENTS

| | | | |
|---|---|---|---|
| 380,683 | 4/1888 | James | 269/305 |
| 744,559 | 11/1903 | Kendrick | 269/45 X |
| 2,182,154 | 12/1939 | Lancaster | 144/291 |
| 2,209,379 | 7/1940 | Bell | 144/291 |
| 2,226,440 | 12/1940 | Parker | 269/305 |
| 2,544,499 | 3/1951 | Hovey | 227/154 |
| 2,588,810 | 3/1952 | Dietrich | 269/910 X |
| 2,811,186 | 10/1957 | Honza | 269/45 |
| 3,112,925 | 12/1963 | Hammer | 269/910 X |
| 3,758,097 | 9/1973 | Newswanger | 269/27 |
| 3,941,291 | 3/1976 | Hayworth | 227/152 |
| 4,102,374 | 7/1978 | Klein | 144/314 B |
| 4,298,195 | 11/1981 | McDougal | 269/32 |

FOREIGN PATENT DOCUMENTS

| | | | |
|---|---|---|---|
| 44-13751 | 6/1969 | Japan | 269/305 |

*Primary Examiner*—Howard N. Goldberg
*Assistant Examiner*—Taylor J. Ross
*Attorney, Agent, or Firm*—Litman, Day & McMahon

[57] ABSTRACT

An apparatus for aligning and clamping a workpiece is provided which includes an easel having a platform mounted thereon. The platform includes a plurality of blocks arranged in spaced relationship in a grid pattern with slots having tapered cross-sectional configurations therebetween. A pair of pneumatic rams are adapted for releasable mounting on the platform and for clamping a workpiece, such as a cabinet frame, while mechanical fasteners are driven into glue joints thereof.

15 Claims, 3 Drawing Figures

APPARATUS FOR ALIGNING AND CLAMPING A WORKPIECE

BACKGROUND OF THE INVENTION

1. Field of the Invention

The present invention relates generally to an apparatus for aligning and clamping a workpiece and in particular to an apparatus for aligning and pneumatically clamping frame assemblies.

2. Description of the Prior Art

In the assembly of various articles of manufacture, it is often desirable to temporarily clamp parts thereof in fixed relation to work surfaces or other parts. For example, when an article is being assembled the parts are often clamped together to apply pressure to glue joints therebetween. Also, the parts may be clamped together in fixed relation while being attached with various types of mechanical fasteners such as dowel rods, nails, screws, corrugated fasteners, staples and the like.

If all of the workpieces and parts are substantially identical, a machine like that shown in the Lancaster U.S. Pat. No. 2,182,154 can be provided and set up for the repetitious assembly of a number of identical parts or subassemblies, for example, frames. However, the Lancaster machine is not readily adaptable to the production of articles or subassemblies in various configurations, particularly where each article or subassembly is likely to have a unique configuration and dimensions.

For example, kitchen, bathroom and other cabinets for residential and commercial structures are often fabricated on a custom or one-of-a-kind basis so that they may be individually sized to properly fit the final dimensions of a particular space in the structure. A typical process for constructing custom cabinetry includes making frames for the cabinet fronts which generally include horizontal and vertical frame members secured together at right angle intersections to form openings for cabinet doors, drawers and the like. Back, bottom and side panels are then attached to the cabinet front frames to form enclosures. For aesthetics and to ensure that the cabinets and various parts thereof will fit properly, the cabinet front frames must be assembled with a relatively high degree of precision, and the right angle intersections should be as square as possible. Accordingly, the cabinet front frame pieces are generally laid out and squared with respect to each other before being fastened.

Typically, the cabinet front frame members are attached at their intersections by glue and mechanical fasteners such as nails, screws, dowels, corrugated fasteners and corner braces. However, it has been determined that most of the strength in such joints results from the glue, with the mechanical fasteners functioning primarily to reinforce the glue joint and to secure it until the glue dries. Thus, it is particularly important that the glue joints in a cabinet front frame be square and that the mating surfaces be clamped together, at least temporarily.

Heretofore, some cabinet fabricators and cabinet shops have employed pipe clamps for tightening the members against each other. However, pipe clamps often tend to cause the frame members to bow due to the pressure being applied slightly off center. Also, pipe clamps generally must be used in conjunction with other apparatus for squaring the cabinet front frames and tend to require time-consuming adjustments between each use on different size frames.

Other parts of a cabinet assembly which require alignment and clamping include the frames for raised panel cabinet doors wherein a frame is provided with a center panel which may embody, for example, an ornamental design.

Clamping and alignment devices are used in the construction of various other articles wherein clamping pressure is required and parts must be properly aligned. Without limitation on the generality of such articles, examples include frames of all sorts, furniture, containers, building components, etc.

Heretofore there has not been available an apparatus for aligning and clamping a workpiece with the advantages and features of the present invention.

SUMMARY OF THE INVENTION

In the practice of the present invention, an apparatus for aligning and clamping a workpiece is provided which includes an easel with a platform mounted thereon. The platform comprises a plurality of blocks with bevelled edges arranged in a grid pattern with aligned rows and columns. The blocks are uniformly spaced from each other to form slots therebetween which are narrowest at front faces of the blocks and widest at back faces thereof. A pneumatic system is provided and includes a pair of rams with rearwardly-angled cleats which are releasably captured within the slots. The rams are provided for exerting clamping pressure on the joints of a workpiece, such as a frame, while a pneumatic fastener gun is employed to secure the joints.

OBJECTS OF THE INVENTION

The principle objects of the present invention are: to provide an apparatus for aligning and clamping a workpiece; to provide such an apparatus which utilizes pneumatic rams; to provide such an apparatus which is particularly well adapted for aligning and clamping a cabinet front frame; to provide such an apparatus which is readily adjustable to accommodate workpieces of various sizes; to provide such an apparatus wherein workpieces may be quickly clamped and fastened; to provide such an apparatus for making glue joints; to provide such an apparatus which accurately joins components at right angles; to provide such an apparatus which allows for the alteration and reassembly of a workpiece after completion; to provide such an apparatus which occupies relatively little floor space; to provide such an apparatus which is operable by a single operator; to provide such an apparatus which is particularly well adapted for making butt joints; to provide such an apparatus which is particularly well adapted for clamping aligned glue joints while a mechanical fastener is driven into the joint; to provide such an apparatus which utilizes a common pneumatic system for fastener guns and rams; and to provide such an apparatus which is efficient in operation, economical to manufacture, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
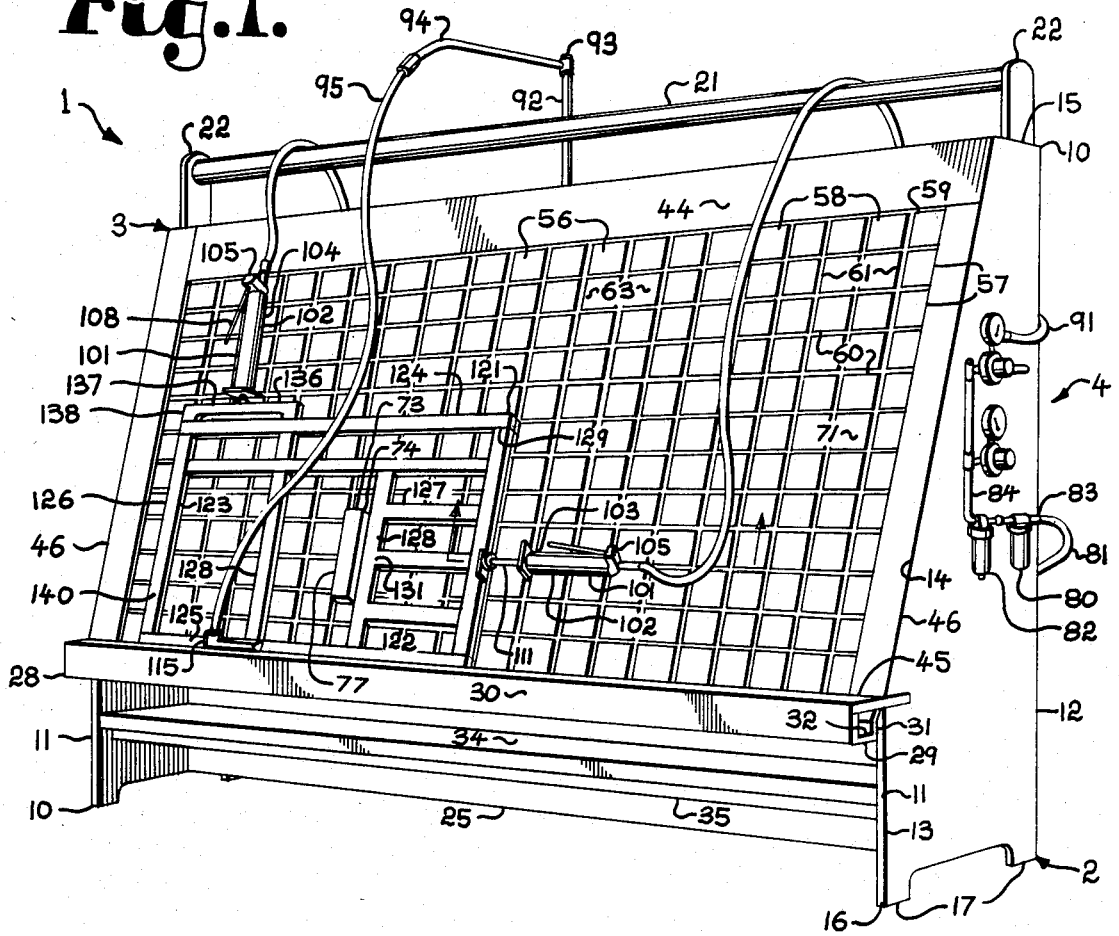
FIG. 1 is a perspective view of an apparatus for aligning and clamping a workpiece embodying the present invention.
Figure 2:
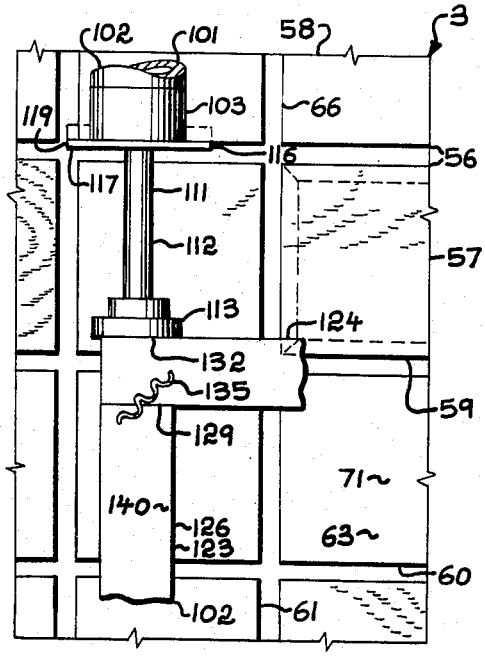
FIG. 2 is an enlarged, fragmentary front elevation of the apparatus.

The terms "upper", "lower", "front", "back", and derivatives thereof refer to the invention as oriented in FIG. 1. However, such directions are not to be interpreted as limiting.

Referring to the drawings in more detail, the reference numeral 1 generally designates an apparatus for aligning and clamping a workpiece and embodying the present invention. The apparatus 1 generally comprises an easel or support structure 2 with a platform 3 mounted thereon and a pneumatic system 4.

The easel 2 includes a pair of end pieces 10 with front and back edges 11, 12. Each front edge 11 includes a vertical lower portion 13 and an upper portion 14 which is slanted rearwardly from bottom-to-top and forms an obtuse angle with respect to the vertical lower portion 13. Each end piece 10 terminates at a top 15 and a bottom 16. The end piece bottoms 16 include pairs of legs 17. An upright base panel 25 extends between the end pieces 10 slightly above their bottoms 16 and in parallel, spaced relation between the front edge lower portions 13 and the back edges 12. A tubular hose rack 21 extends horizontally for the length of the easel 2 between hose rack supports 22 which extend upwardly from respective end piece tops 15.

A horizontal trough 28 projects forwardly from the upper ends of the end piece front edge lower portions 13 for the length of the easel 2. The trough includes a trough floor 29 and front and back trough walls 30, 31 forming a channel 32 therebetween. The trough back wall 31 is attached to the end pieces 10 at the upper ends of their front edge lower portions 13. The trough front wall 30 is retained in substantially parallel position with respect to the trough back wall 31 by a pair of trough straps 33 each attached to a respective end of the trough front wall 30 and to the side of a respective end piece 10.

A horizontal shelf 34 extends between the end pieces 10 in spaced relation below the trough 28 and abuts the base panel 25. A shelf cross piece 35 extends horizontally between the end pieces 10 adjacent to their front edge lower portions 13 and supports the shelf 34.

The platform 3 includes a base 41 comprising, for example, a sheet of three-quarter inch plywood with front and back faces 42, 43. The base 41 is bounded at its front face 42 by top, bottom and side rails 44, 45 and 46. The base 41 is attached to the easel 2 at the end piece front edge upper portions 14. Thus, the platform 3 is tilted slightly rearwardly from the vertical with a rearward slope from bottom-to-top.

A plurality of column backings 51 are placed on the base front face 42 in juxtaposed, parallel relation between the top and bottom rails 44, 45. The column backings 51 preferably comprise flat strips of material mounted on the base front face 42 with side edges 52 thereof abutting each other and, in the case of the two outermost column backings 51, the side rails 46. Each column backing 51 includes front and back faces 53, 54.

A plurality of blocks 56 are mounted on the column backings 51 in rows 57 and columns 58 whereby a grid-like slot network 59 is formed which comprises side-to-side slots 60 and top-to-bottom slots 61. Each column 58 of blocks 56 is mounted on a respective column backing 51. Each block 56 includes square front and back faces 63, 64, the back faces being smaller whereby the four edges 65 of each block 56 are bevelled and form acute angles with respect to the front faces 63 at front face margins 66 and obtuse angles with respect to the back faces 64 at back face margins 67. Thus, the blocks 56 have frusto-pyrimidal configurations. Each slot 59 includes a front portion 68 which is considerably narrower than a back portion 69 thereof. For example, the block front faces 63 may be four inches by four inches square and spaced so that the slot front portions 68 are one-quarter of an inch wide. The slots 59 may widen to back portions 69 which are, for example, one-half inch to three-quarters of an inch wide. The block front faces 63 define a planar front surface 71 of the platform 3 from which the rails 44, 45 and 46 project forwardly.

The blocks 56 are removably mounted on respective column backings 51 by countersunk wood screws 49 with the block back faces 64 in opposed relation to respective column backing front faces 53. The column backings 51 are removably mounted on the base 41 by countersunk wood screws 49 with the column backing back faces 54 in opposed relation to the base front face 42. Thus, the blocks 56 are easily replaceable by unscrewing the column backings 51 on which they are mounted and then unscrewing the damaged blocks 56. Alternatively, the blocks 56 could be permanently mounted on the column backings 51, as by gluing, whereby entire column backings 51 could be changed to replace damaged blocks 56.

A movable stop bar 73 includes a strip of wood 74 and a metal cleat strip 77 which extends rearwardly from the wood strip 74 and is slightly slanted from a direction perpendicular thereto. The cleat strip 77 forms an acute angle with respect to a back face of the wood strip 74.

The pneumatic system 4 includes an air compressor (not shown) connected to the apparatus 1 by a main air hose 81. The main air hose 81 is attached to a filter 80 and a condensation trap 82 mounted on an end piece 10 by a quick-release coupling 83. An air manifold 84 extends from the condensation trap 82 and communicates pressurized air to a ram regulator 85 and a fastener gun regulator 86. A pair of ram air hoses 87 are connected to the ram regulator 85 and extend behind the platform 3 and over the tubular hose rack 21. The ram air hoses 87 terminate at quick-release couplings 83 and are long enough so that they may be positioned at desired locations all over the platform 3.

A fastener gun regulator hose 91 extends from the fastener gun regulator 86 and is coupled to a vertical air pipe 92 mounted on the back of the easel 2 and extending upwardly above the hose rack 21. A swivel connection 93 is rotatably mounted on top of the vertical air pipe 92. A rigid air boom 94 cantilevers forwardly from the swivel connection 93 over and in front of the platform 3. A fastener gun air hose 95 is attached to the air boom 94 by a quick-release coupling 83 and includes another coupling 83 at its free end. A pneumatic fastener gun 115 is attached to the end of the fastener gun air hose 95 by a quick-release coupling 83.

A pair of double-acting pneumatic rams 10 are attached to the ram air hoses 87 by the quick-release couplings 83. Each ram 101 includes a cylinder body 102 with front and back ends 103, 104. A respective ram air hose 87 is attached to the back end 104 of each cylinder body 102 by a respective coupling 83. A three position control valve 105 is mounted on the cylinder body back end 104 and is adapted for communicating air from the ram air hoses 87 to either the front or back end 103, 104 of a respective cylinder body 102. A valve actuator arm 108 extends from the control valve 105.

A piston 111 is reciprocably mounted within the cylinder body 102 and includes a piston rod 112 extending from the cylinder front end 103. The piston rod 112 terminates at an abutment disc 113 faced with a resilient material. The actuator arm 108 includes a neutral position whereby both cylinder ends 103, 104 are closed and the piston 111 maintains its position. When the actuator arm 108 is pressed towards the cylinder body 102, pressurized air is communicated to the cylinder back end 104 and the piston rod 112 extends. When the actuator arm 108 is pulled away from the cylinder body 102, the piston rod 112 retracts. The actuator arm 108 is spring-loaded so that when released it returns to its neutral position.

Each ram 101 includes a sheet metal ram cleat 116 with a proximate portion 117 mounted on the cylinder body front end 103 and a distal portion 118 extending outwardly from the cylinder body 102. The ram cleat portions 117, 118 are both substantially flat and are angled with respect to each other whereby a dihedral angle is formed therebetween. The ram cleat 116 is oriented with the distal portion 118 thereof extending rearwardly from the proximate portion 117 and with respect to the cylinder body 102. The cleat distal portion 118 includes side edges 119 and a distal end 120.

A workpiece comprising a cabinet front frame 121 is placed on the front surface 71 of the platform 3. The cabinet front frame 121 includes a plurality of drawer openings 122 and a pair of door openings 123. The openings 122, 123 are rectangular and are defined by frame members including top and bottom members 124, 125; side members 126; drawer divider members 127; and intermediate post members 128. The members 124–128 are interconnected at corner, exterior and interior butt joints 129, 130 and 131 respectively. Although the apparatus 1 comprising the present invention may be used to clamp and align various members with other types of joints such as miter, mortise and tennon, dowel pin and the like, it has been found that ample strength is obtained in the butt joints 129–131 by applying glue under pressure and utilizing mechanical fasteners.

In the assembly of the cabinet front frame 121, mating surfaces of the members 124–128 are coated with glue. The members 124–128 are then placed on the platform in the positions that they are intended to assume in their final configurations, with their mating surfaces engaged. Usually at least one member is placed against a rail 44, 45 or 46 of the platform 3 and the member to be connected thereto is laid on the platform front surface 71 with the mating surfaces engaged and the members in perpendicular relation. The cabinet front frame 121 is preferably assembled with a front face 139 thereof against the block front faces 63 and a back face 140 thereof exposed so that fasteners are installed from the back side and are thus concealed from view in the finished cabinet.

The square grid pattern 55 formed by the slot network 59 may be used to help align the members in perpendicular relation. When the members 124–128 are properly positioned with respect to each other and the mating surfaces are in engagement, one of the rams 101 is positioned for clamping the respective joint 129, 130 or 131.

Figure 3:
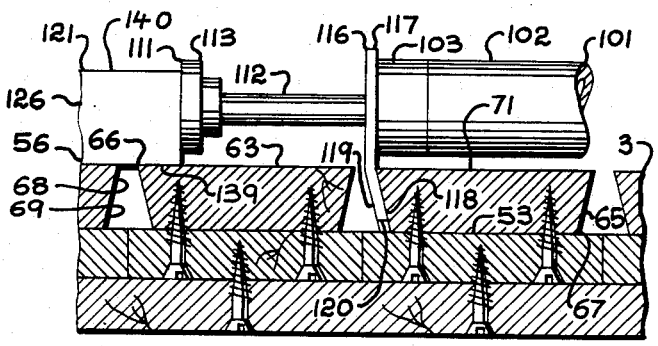
FIG. 3 is an enlarged, fragmentary cross-section of the apparatus taken generally along line 3—3 in FIG. 1.

The rams 101 may be positioned at various locations on the platform 3 in either vertical or horizontal orientations. The rams 101 are removably secured in place by inserting their cleat distal portions 118 into respective slots 60, 61. As shown in FIG. 3, the ram cleat distal portions 118 form angles with the longitudinal axes of the rams 101 which correspond to the acute angles formed between the block front faces 63 and their bevelled edges 65 whereby the ram cleat distal portions 118 fit substantially flush against respective bevelled block edges 65. The rams 101 are thus adapted to hang suspended by their cleats 116 in the side-to-side slots 60.

The rams 101 will also remain suspended on the platform 3 in substantially horizontal configurations with their cleats 116 inserted into top-to-bottom slots 61. When a cleat 116 is inserted into a top-to-bottom slot 61 and the ram 101 is released by an operator, most of the weight of the ram 101 is located behind the cleat 116 so that the ram 101 rotates slightly about the cleat 116. The side edges 119 of the cleat 116 are thus forced into engagement with opposite bevelled block edges 65 in a respective top-to-bottom slot 61. Therefore, as the rams 101 sag at their cylinder body back ends 104, they exert considerable leverage to rotate the cleats 116 whereby a relatively secure engagement is formed and the rams 101 are prevented from sliding downwardly on the platform 3.

The ram piston rods 112 will extend for a distance greater than the combined width of at least two blocks 56, i.e. about eight inches. Therefore, the entire surface area of the platform 3 is accessible to the ram abutment discs. Generally, the piston rod 112 will be extended less than the width of a single block 56.

With the frame members 124–128 properly positioned on the platform 3, the ram is positioned so that its abutment disc 13 is aligned with a pressure point 132 in a joint 129, 130 or 131. The piston rod 112 is also in alignment with the joint. Glue has been applied to the mating surfaces in the joint, but preferably has not been allowed to set up. The operator presses the actuator arm 108 whereby the rod 112 extends and the abutment disc 113 engages the pressure point 132 for tightly clamping the butt joint between the respective members. The cooperation between the angled ram cleat distal portion 118 and a respective block bevelled edge 65 holds down the ram cylinder body front end 103. The ram cylinder body 102 is thus held substantially flush against the platform front surface 71 along its entire length. The cabinet front frame 121 is also held against the platform front surface 71 by the pressure from the piston abutment disc 113 at the pressure point 132.

The fastener gun 115 is then placed over the butt joint 129, 130 or 131 and a corrugated fastener 135 is driven into the members in straddling relation over the joint. Corrugated fasteners 135 are preferred because they tend to draw the mating surfaces tightly together and may be inserted from the back faces of the frame members 124–128 for a flush fit therewith. Thus, the corrugated fasteners 135 are concealed from view in the finished cabinet and do not require access to edges of the frame members 124–128. However, it is anticipated that the apparatus 1 comprising the present invention could also be successfully employed with various other types of mechanical fasteners including, without limitation, nails, screws, corner braces, etc. Also, other types of joints may be formed with the apparatus 1, including mortise and tennon joints, dove tail joints, miter joints, etc.

The ram 101 is released by lifting the actuator arm 108 to retract the piston rod 112. The ram 101 may be released immediately after placing the fastener 135, since the latter will continue to maintain clamping pressure in the joint 129. Alternatively, the ram 101 may be left in place until the glue in the joint 129 sets, although this curing period is generally not required. However, the previous method is preferred since construction is considerably expedited thereby and the operator can make all of the required joints in rapid succession.

The remaining joints 129, 130 and 131 in the cabinet front frame 121 are made in a similar manner, generally by placing one of the members against a rail 44, 45 or 46 and by placing the rams 101 on the platform 3 as required. For interior butt joints 131, for example between the inside ends of the drawer divider members 127 and the intermediate post members 128, the stop bar 73 is used as a backup. As shown in FIG. 1, the stop bar cleat 77 is placed in a slot 60 or 61 in engagement with an interior member, such as the intermediate post member 128. A ram 101 is then used to apply pressure to the joint 131 and a corrugated fastener is set to maintain the members 127, 128 in clamped engagement.

A pressure point bridge 136 is provided and includes a middle portion 137 and a pair of legs 138 extending therefrom at either end. The bridge 136 is used as shown in FIG. 1 to simultaneously apply pressure to two pressure points 132 with a single ram 101.

The relatively steep pitch of the platform 3 offers at least two advantages. First of all, the amount of floor space occupied by the apparatus 1 is thereby kept to a minimum, which is particularly important in relatively small shops which must efficiently use all available floor space. Secondly, all areas of the platform 3 and the cabinet front frame 121 are within easy reach. The cooperation between the slots 60, 61 and the ram cleats 116 allow the rams 101 to be freely suspended on the platform 3 in virtually any desired position or orientation in spite of the relatively steep pitch of the latter.

The fastener gun 115 may be placed in the trough channel 32 until needed by an operator. The swivel-mounted air boom 94 allows the fastener gun 115 to be placed all over the platform front surface 71. The trough 28 and the shelf 34 are useful for storing various items used in the assembly of the cabinet front frames 121 such as corrugated fasteners 135, glue, etc.

By way of example, the ram air pressure may be 120 P.S.I. The ram cylinder bodies 102 may have diameters of 2.75 inches for cross-sectional areas of approximately 5.93 square inches each. Based upon these exemplary specifications, the clamping pressure would be approximately 713 pounds, which has been determined to be adequate for the disclosed use of the apparatus 1.

Although the apparatus 1 has been described in connection with the assembly of a cabinet front frame 121, it is useful for aligning and clamping various other types of workpieces. For example, many cabinets have raised panel cabinet doors wherein a frame is provided which could be assembled on the apparatus 1 comprising the present invention.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for aligning and clamping a workpiece, which comprises:

(a) an easel having opposite end pieces each including a respective front edge, said easel including a tubular hose rack extending transversely above said end pieces;

(b) a platform including:

(1) a base with front and back faces;

(2) top, bottom and side rails mounted on said base and surrounding same;

(3) a plurality of juxtaposed column backings extending between said top and bottom rails, each said column backing including opposite side edges and front and back faces, said column backings being mounted on said base in juxtaposed relation with said column backing back faces in opposed relation to said base front face;

(4) a plurality of blocks mounted on each column backing to form respective block columns, each said block having bevelled side edges and front and back faces, said block front faces being larger than said block back faces and each block being mounted on a respective column backing with said block back face in opposed relation to said column backing front face;

(5) said blocks being mounted on said column backings and said column backings being mounted on said base whereby said block edges are in spaced relation and form a grid-like network of slots therebetween including side-to-side continuous slots and top-to-bottom continuous slots, each said slot being narrower adjacent said block front faces and wider adjacent said block back faces;

(c) said block front faces forming a platform front surface with said top, bottom and side rails projecting therefrom; and (d) a pneumatic system including:

(1) a regulator valve mounted on said easel and adapted for connection to a pressurized air source;

(2) an air hose connected to said regulator valve and slidably draped over said hose rack; and (3) a pneumatic ram connected to said air hose, said pneumatic ram including a ram cleat angled rearwardly with respect to said ram and adapted for being releasably received in said slots.

2. An apparatus for aligning and clamping a workpiece, which comprises:

(a) a platform including:

(1) a substantially planar surface adapted for receiving the workpiece thereon;

(2) a network of continuous slots open at said surface and extending into said platform, said slots comprising a plurality of top-to-bottom slots and side-to-side slots forming a grid pattern on said surface; and (3) each said slot having a front portion and a back portion, said slot front portions being narrower than said slot back portions;

(b) alignment means projecting from said platform surface and adapted to engage said workpiece for aligning same with respect to said platform; and (c) a fluid-actuated ram including a cylinder body and an extensible and retractable piston, said ram including a cleat removably insertable in said slots.

3. The apparatus according to claim 2 wherein said platform includes:

(a) a base;

(b) a plurality of juxtaposed column backings mounted on said base; and (c) each said column backing having a respective column of said blocks mounted thereon.

4. The apparatus according to claim 2 wherein:

(a) said platform includes and is bounded by top, bottom and side rails projecting forwardly from the surface thereof.

5. The apparatus according to claim 2, which includes:

(a) a stop bar having a cleat extending therefrom and adapted for insertion in said slots.

6. The apparatus according to claim 2, which includes:

(a) a fluid pressure distribution system mounted on said easel and having a ram pressure regulator for regulating fluid pressure to said ram and a fastener gun pressure regulator for regulating fluid pressure to a fastener gun.

7. The apparatus according to claim 2, which includes:

(a) a pressure point bridge including a middle portion and a pair of legs extending therefrom, said middle portion being engagable by said piston whereby pressure is exerted by each said leg.

8. The apparatus according to claim 2 wherein said platform includes:

(a) a base;

(b) a plurality of blocks each having front and back faces and bevelled edges; and (c) block mounting means adapted for mounting said blocks in said rows and columns on said base with said block edges in spaced relation whereby said slots are formed therebetween.

9. The apparatus according to claim 8 wherein:

(a) said block mounting means comprises a plurality of column backings attached to said base in juxtaposed relation, each said column backing having a plurality of blocks mounted thereon.

10. The apparatus according to claim 2, which includes:

(a) said ram cylinder body having front and back ends with said piston extending from said front end; and (b) said ram cleat being angled rearwardly with respect to said cylinder body.

11. The apparatus according to claim 10 wherein:

(a) said platform slopes rearwardly from bottom-to-top; and (b) said cleat is adapted to freely suspend said ram on said platform in either a top-to-bottom or side-to-side orientation.

12. The apparatus according to claim 2, which includes:

(a) an easel; and (b) said platform being mounted on said easel in a position tilted rearwardly from bottom-to-top.

13. The apparatus according to claim 12, which includes:

(a) a trough mounted on said easel below said platform.

14. The apparatus according to claim 12, which includes:

(a) said easel having a tubular hose rack extending transversely above said platform; and (b) a flexible fluid hose slidably draped over said hose rack and connected to said ram.

15. The apparatus according to claim 12, which includes:

(a) a fluid pressure system having a vertical fluid pipe mounted on said easel and communicating with a source of pressurized fluids, a pressurized fluid boom mounted on said vertical pipe in a swivel connection therewith, a fastener gun hose connected to said boom and adapted to receive a fastener gun.

* * * * *